United States Patent [19]

Castelli

[11] Patent Number: 5,060,421

[45] Date of Patent: Oct. 29, 1991

[54] CHILD AND INFANT RESTRAINT AND FASTENER

[76] Inventor: Dario D. Castelli, 26 Woodland Dr., Pittsburgh, Pa. 15228

[21] Appl. No.: 545,844

[22] Filed: Jun. 29, 1990

[51] Int. Cl.[5] ..... E05B 3/32

[52] U.S. Cl. ..... 49/463; 24/31 V

[58] Field of Search ..... 297/DIG. 6; 248/205.2; 52/DIG. 13; 24/31 V, 16 R, 442; 128/DIG. 15; 49/463, 55, 56, 57

[56] References Cited

U.S. PATENT DOCUMENTS

| | | | |
|---|---|---|---|
| 3,441,037 | 4/1969 | Transeau | 135/1 |
| 3,461,511 | 8/1969 | Perina | 24/31 V |
| 3,543,977 | 12/1970 | Lockridge | 128/DIG. 15 X |
| 3,571,999 | 3/1971 | Downing | 52/483 |
| 3,638,284 | 2/1972 | Baker | 24/73 CF |
| 3,691,688 | 9/1972 | Kaiserwerth | 49/394 |
| 3,950,894 | 4/1976 | Dimaio | 49/501 |
| 4,094,021 | 6/1978 | Rapp | 4/172.12 |
| 4,325,533 | 4/1982 | Tiletschke | 249/188 |
| 4,569,348 | 2/1986 | Hasslinger | 24/16 R X |
| 4,615,142 | 10/1986 | Reeves | 49/55 |
| 4,677,791 | 7/1987 | Larson et al. | 49/463 |
| 4,719,876 | 1/1988 | Wilken | 128/DIG. 15 X |
| 4,848,030 | 7/1989 | Bennett | 49/57 |
| 4,862,563 | 9/1989 | Flynn | 24/31 V X |
| 4,879,854 | 11/1989 | Handler | 52/DIG. 13 X |

FOREIGN PATENT DOCUMENTS

| | | | |
|---|---|---|---|
| 212089 | 5/1957 | Australia | 49/55 |
| 2041051 | 9/1980 | United Kingdom . | |
| 2129473 | 5/1984 | United Kingdom . | |

*Primary Examiner*—Rodney M. Lindsey
*Assistant Examiner*—Jerry Redman
*Attorney, Agent, or Firm*—Ansel M. Schwartz

[57] ABSTRACT

A child restraint includes a gate that can be closed to impede passage by a child or infant through an accessway. The restraint includes a fastener for releasably securing the gate in its closed position. Two separate sequential manipulations are required to unfasten the fastener, which renders it difficult for an infant or child to unfasten the fastener, yet permits quick and easy unfastening by an adult. The restraint can include a gate that is collapsible to permit the restraint to be quickly and easily removed from one accessway and remounted in another accessway.

A fastener for releasably securing an article in a desired position includes three strips of hook and loop type fastening material. An intermediate strip can be positioned between the two remaining strips. The hook and loop material releasably secures the three members together as a unit. Two sequential operations are required to release the members from each other, thereby requiring two sequential manipulations to release the article from its position.

4 Claims, 3 Drawing Sheets

CHILD AND INFANT RESTRAINT AND FASTENER

BACKGROUND OF THE INVENTION

The present invention relates to restraints and, more particularly, to a restraint employed to restrict the movement of infants and small children.

Child restraints long have been in use to confine infants and small children to a desired area, or to prevent them from wandering into areas in which they are not permitted. Commonly, the gates are mounted within accessways, that is doorways or passageways, or at the top or bottom of stairs.

A child or infant restraint should satisfy at least two requirements. First, by blocking or impeding the passage of an infant or child through the accessway, the restraint also significantly impedes passage of an adult. If the restraint can be relatively easily removed from the accessway, the restraint can be removed to allow the adult to pass, and then remounted. However, a better solution is provided if the restraint includes a barrier or gate that can be opened to permit passage without removing the restraint entirely from the accessway. Second, if the gate can be disengaged and opened to permit passage through the accessway without removing the restraint entirely, it is important to be able to secure the gate in the closed position with a fastener or locking mechanism that is difficult for infants and children to open. However, an adult must be able to open the barrier quickly and easily and, therefore, the fastener should be easily and quickly operable by an adult.

It is also helpful if the gate satisfies two additional requirements. During a typical day in the home, the parent attending a child commonly needs to confine the child to the area occupied by the parent. Since that area changes throughout the home during a typical day, the area in which the child is confined changes. Since the child restraint is an integral component of the means used to confine the area of movement of the child, the parent should be able to move the restraint from accessway to accessway as the day progresses. Therefore, it should be easy to mount the restraint within and remove the restraint from an accessway. Also, accessways within a typical home can be of different widths. Therefore, it should be easy to adjust the width of the restraint.

None of the known restraints includes a gate that can be quickly and easily opened and closed by an adult, but which is difficult for a child to open. Further, none of the known restraints can meet those requirements while providing a restraint whose width is easily adjustable and that can be easily and quickly mounted within and removed from an accessway. Known restraints commonly include a barrier or gate that can be positioned in the accessway to block it, a mounting by which the restraint can be secured within the accessway and a fastener or locking mechanism that is provided to prevent children and infants from retracting the gate. The gate can be extended and retracted in a number of ways. Commonly, the gate can be folded or collapsed against one side of the accessway to permit passage, and extended to a locking mechanism mounted to the remaining side of the accessway. Another type of restraint forms a gate consisting of a pair of partitions that can be slid along each other to increase or reduce the width spanned by the gate. Still other gates are mounted on spring biased telescoping rods which can be compressed or allowed to expand to adapt the gate to different sized accessways. Other restraints include gates that are hinge mounted to one side of the accessway to allow the gate to swing between opened and closed positions.

SUMMARY OF THE INVENTION

The present invention provides a restraint for impeding passage through an accessway that includes a barrier sized to impede passage through the accessway when the barrier is secured in a closed position. A mounting secures the barrier at a first mounting location, the mounting permitting the barrier to be moved to and from the closed position. A closing fastener releasably secures the barrier in the closed position at a second mounting location. At least two sequential manipulations of the closing fastener are required to release the barrier from the closed position. Preferably, the door remains releasably secured in the closed position after conducting the first manipulation and prior to conducting the second manipulation.

Preferably, the width of the restraint can be adjusted to accommodate accessways of different widths. Also preferably, the device includes apparatus for quickly and easily mounting the device within an accessway and removing the device from an accessway.

The present invention also provides a fastener for releasably securing an article in a desired position, comprising three fastening members. An intermediate fastening member is adapted to be releasably secured to each of the remaining two fastening members. At least two sequential manipulations of the fastening members are required to move the article from the desired position. The article remains releasably secured in the desired position after conducting the first manipulation and prior to conducting the second manipulation.

BRIEF DESCRIPTIONS OF THE DRAWINGS

The following detail description of the preferred embodiments can be understood better if reference is made to the accompanying drawing, in which.

DETAILED DESCRIPTION OF THE PREFERRED EMBODIMENTS

Figure 1:
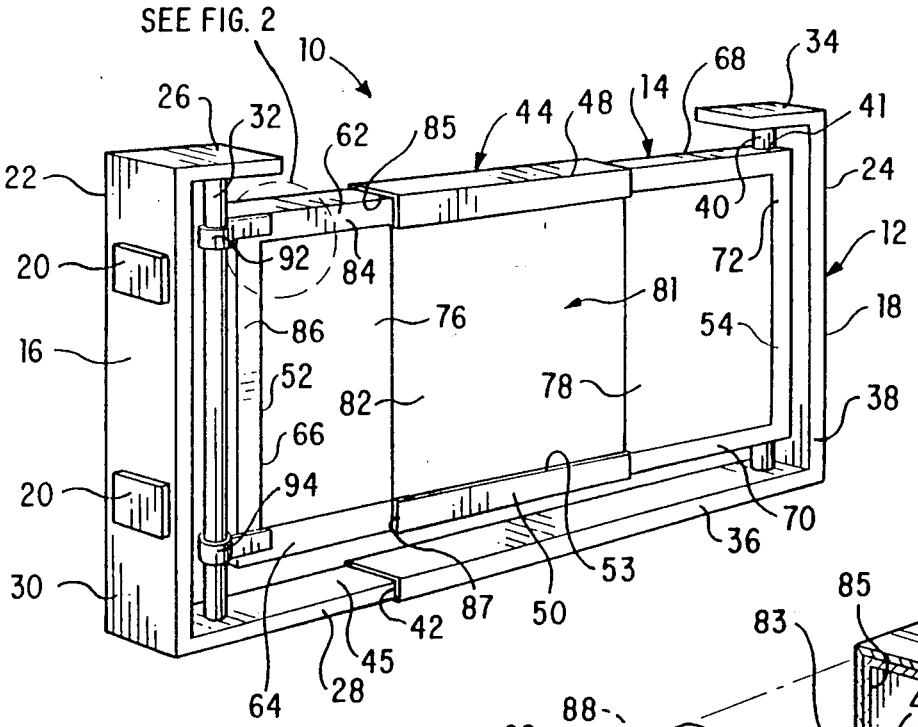
FIG. 1 is a perspective view of a child restraint provided by the present invention.
Figure 2:
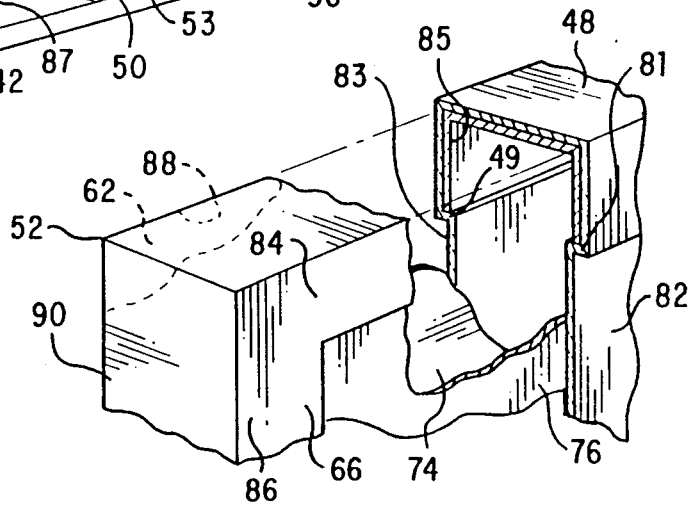
FIG. 2 is a cutaway view of a portion of the gate or barrier of the restraint shown in FIG. 1.
Figure 3:
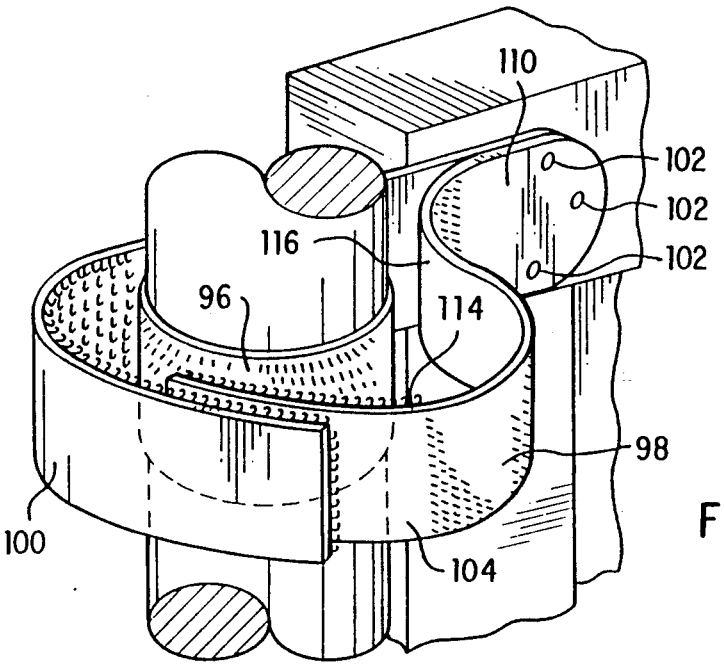
FIG. 3 is a perspective view of a portion of the restraint shown in FIG. 1, showing a fastener.

FIGS. 1 through 3 show the details of a child restraint that can be adjusted to accommodate accessways of different widths. The restraint can be constructed of any suitable wood, metal, plastic and fiberboard. The restraint provided by the present invention can include a number of types of gates or barriers that are mounted in a variety of ways to permit the gate to be moved between an opened and closed position. However, for purposes of illustration only, restraint 10 includes a gate that is mounted to swing on a bar between an opened and closed position. Restraint 10 also includes a frame that is mounted directly to the accessway and to which the gate is mounted. The frame includes a pair of telescoping members that can be slid with respect to each other to adjust the width of the frame to permit it to be mounted in accessways of different widths. The gate itself defines a frame having telescoping members that also are slidable relative to each other to permit the width of the gate to be adjusted to match the width of the restraint frame. The gate also includes panels that are located within the gate frame and block passage through the opening defined by the frame. Some of the panels also are slidable with respect to each other to permit adjustment to the width of the area spanned by the panel assembly to ensure that no openings are provided through the frame when it is extended. The restraint frame includes a suitable fastener or locking mechanism, for example a hook and loop type fastener, which permits mounting of the restraint frame quickly and easily to the accessway. Restraint 10 includes a pair of hook and loop fastener assemblies which are used to secure the gate to the restraint frame in the closed position. The gate hook and loop fastener assemblies are easily unfastened by adults but cannot be unfastened easily by small children or infants. Also, the sound made by a hook and loop fastener when it is released provides an audible indication that the infant or child is attempting to release the fastener to open the gate.

Figure 7:
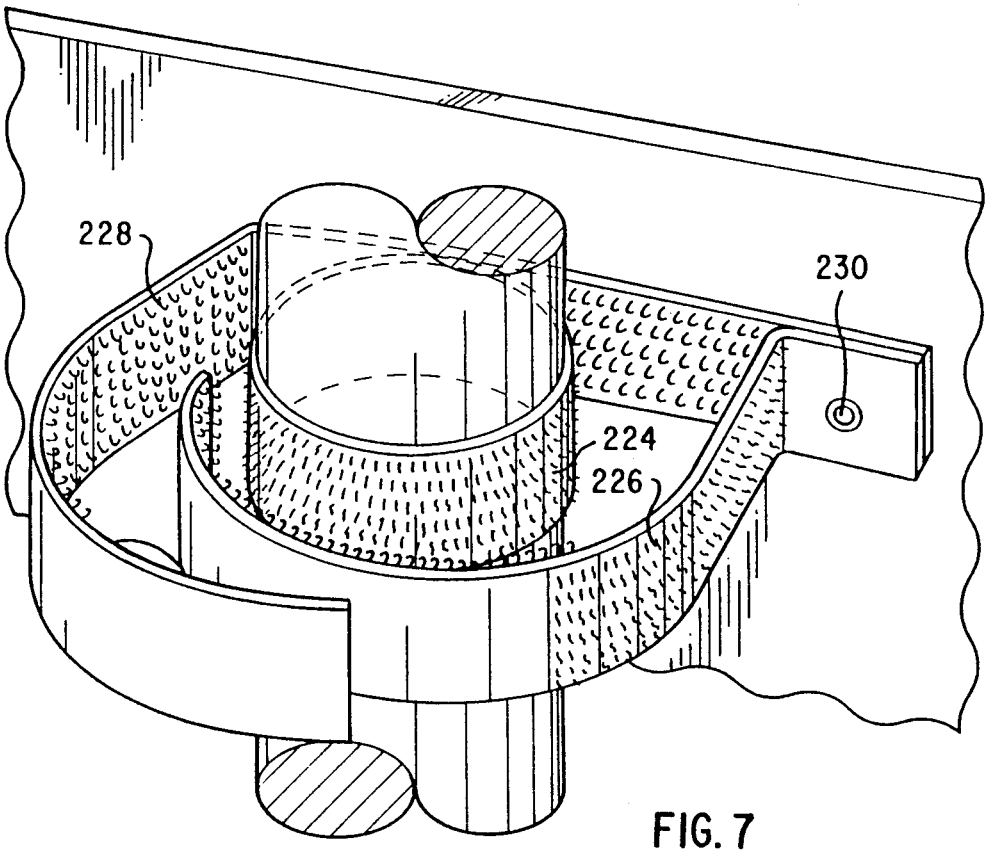
FIG. 7 is a perspective view of a portion of the restraint shown in FIG. 5, showing in particular the gate fastener.
Figure 6:
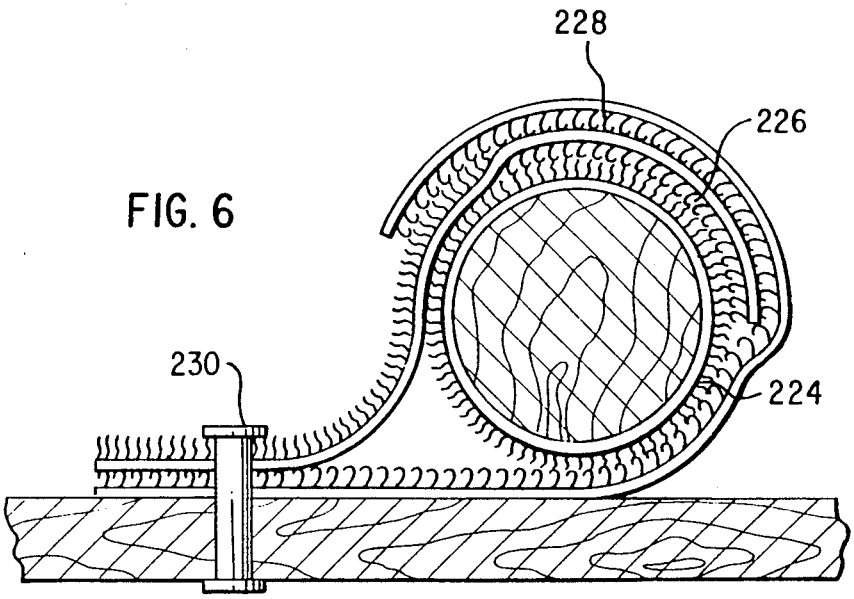
FIG. 6 is a top sectional view showing the fastener of the restraint shown in FIG. 5.
Figure 5:
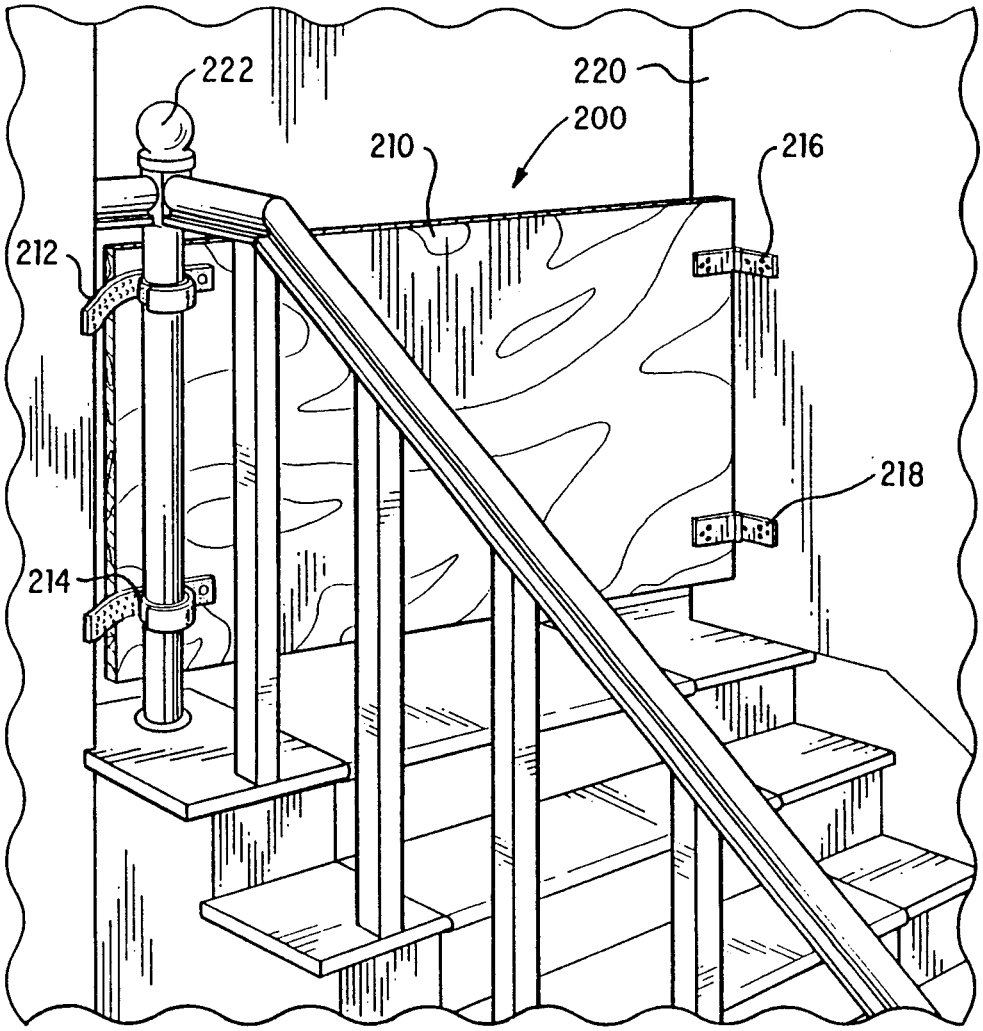
FIG. 5 is a perspective view showing an alternate embodiment of the present invention mounted at the top of a set of stairs.

FIGS. 5 through 7 show an alternate restraint provided by the present invention. Restraint 200 is designed to be installed substantially permanently in an accessway. Accordingly, the gate of restraint 200 is hinged to one side of the accessway, for example a wall, to permit it to swing between its opened and closed positions. Because the width of restraint 200 need not be adjustable, the gate can be a rigid planar member. Gate fasteners of the type employed with restraint 10 are employed with restraint 200.

Restraint 10 includes, generally, a frame 12, which is mounted to the accessway, and a barrier or gate 14. The exact configuration of frame 12 will depend on the nature of the accessway. Frame 12 defines a pair of planar mounting surfaces 16 and 18, which are adapted to engage the walls forming the boundaries of the accessway. A pair of loop fasteners 20 is secured to each surface 16 and 18. A pair of hook fasteners (not shown) is secured to each wall defining the accessway. The hook fasteners are so spaced that they are aligned with loop fasteners 20 when frame 12 is positioned as desired in the accessway.

Frame 12 is formed from a pair of frame members 22 and 24. Frame member 22 defines upper member 26, lower member 28, and side member 30, which defines mounting surface 16. Upper member 26 and lower member 28 extend from side member 30 in the same direction at generally right angles to side member 30. A fastening bar 32 is mounted at one end to lower member 28 and at the remaining end to upper member 26. Fastener bar 32 can be mounted in any suitable fashion, for example by gluing the ends of bar 32 into offsets formed in members 26 and 28.

Similarly, frame member 24 defines an upper member 34, a lower member 36 and a side member 38, which defines mounting surface 18. A mounting bar 40 is mounted to frame member 24. One end of bar 40 is secured to the underside of upper member 34 and the remaining end of bar 40 is secured to the upper surface of member 36. Bar 40 can be secured to members 34 and 36 in the same fashion as bar 32 is secured to members 26 and 28

Member 28 is adapted to slide within member 36 of frame member 24. Accordingly, member 36 defines a U-shaped track 42 that is sized to receive end 45 of lower member 28. Frame members 22 and 24 can be slid toward each other to retract or collapse frame 12, to reduce the width of frame 12, or slid apart to extend frame 12 and widen it.

Gate 14 is mounted on mounting post 40. Gate 14 is adapted to pivot around post 40 to permit gate 14 to be swung between its opened and closed positions. Gate 14 includes a frame 44 and four panels, a pair of distal panels 74 and 76, and a pair of proximal panels 78 and a panel not shown. Gate frame 44 is formed from central frame member 81 and side frame members 52 and 54. Panels 74 and 76 are mounted to frame member 52; and panel 78 and the proximal panel not shown are mounted to frame member 54. Central frame member 81 defines upper member 48, lower member 50 and central panels 82 and 83.

Side member 52 defines upper member 62 and lower member 64, which extend generally in the same direction from a side member 66 at right angles to member 66. Similarly, side member 54 defines upper member 68 and lower member 70, which extend from a side member 72 generally in the same direction at right angles to member 72. Central members 48 and 50 form shoulder 49, 51, 53 and a shoulder not shown at which panels 82 and 83, respectively, are joined, and which define square-shaped channels 85 and 87 which receive members 62 and 64, as can be seen more clearly in FIG. 2 with respect to upper member 62 and central member 48 of gate frame 44. The arrangement for supporting members 64, 68 and 70 is the same as that shown in FIG. 2.

Gate frame 44 receives panels 74, 76, 78 and the proximal panel not shown and restricts their lateral movement. In particular, gate 14 includes a pair of distal panels 74 and 76, a pair of proximal panels, proximal panel member 78 and a second panel member not shown, and central panel members 82 and 83, which are part of central frame member 81. Panel members 74, 76, 78, 82, 83 and the proximal panel member not shown cooperate to permit the extension and collapse of gate 14 while preventing the development of an opening in gate 14 through which an infant or child can pass.

Panels 74 and 76 are secured within gate frame side member 52 in any suitable fashion. FIG. 2 shows the manner of securing panel members 74 and 76 within gate frame members 62 and 66. In particular, the edges of panel members 74 and 76 are secured to the inner surfaces of members 62 and 66. Also, the sides of panels 74 and 76 can be secured to the flanges 84, 86, 88 and 90 of members 62 and 66. The proximal side panels are mounted to frame member 54 in similar fashion.

Post 40 passes through an opening 41 defined at the top of member 72 and another opening (not shown) defined at the bottom of member 72. Then, member 72 is secured to post 40 in any suitable fashion that permits gate 14 to swing on post 40.

The proximal and distal panel members are free to slide toward each other when gate frame 44 is collapsed and away from each other when gate frame 44 is extended without creating an opening in gate 14 through which a child or infant could pass.

A pair of hook and loop locking mechanisms or fasteners 92 and 94 is secured to gate frame members 62 and 64, respectively. Fasteners 92 and 94 are used to releasably secure gate 14 in its closed position. Each fastener includes three fastener strips 96, 98 and 100. Each of intermediate strip 98 and outer strip 100 are secured at one end to a gate frame member using three rivets 102. In particular, one end of outer strip 100 is positioned directly on the gate frame member and one end of intermediate member 98 is positioned on top of it. Rivets 102 then are inserted through both strips. The length of strip 96 is substantially identical to the circumference of mounting bar 32 so that it completely encircles it. Strip 96 can be secured to bar 32 in any suitable fashion, for example, by gluing.

To close fastener 92 or 94, strip 98 is first wrapped around strip 96 and then strip 100 is wrapped around strips 96 and 98. The side of strip 100 facing the gate frame member is smooth, while the remaining side constitutes the loop material of a hook and loop fastener along its entire length. Strip 98 includes a segment constituting the hook material of a hook and loop fastener and a second segment constituting loop material. In particular, surface 104 of strip 98 defines a smooth segment 108 and a hook segment 110. Similarly, surface 106 of strip 98 defines a smooth segment 116 and a loop segment 114. Loop segment 114 extends to the end of strip 98.

Gate 10 is secured within an accessway by collapsing frame 12 and gate 14 sufficiently to permit gate 10 to be placed in the accessway. Fasteners 92 and 94 are secured to bar 32 and loop fasteners 20 are aligned with the corresponding hook fasteners on the sides of the accessway. Frame 12 is extended until loop fasteners 2 mate with the corresponding hook fasteners. As frame 12 is expanded gate 14 also expands as required. Removal of restraint 10 from the accessway is accomplished simply by collapsing frame 12 until loop fasteners 20 become disengaged from the corresponding hook fasteners.

Fasteners 92 and 94 are fastened to bar 32 by moving gate 14 to its closed position. Strip 98 is wrapped around strip 96 so that loop segment 114 of strip surface 104 is engaged with strip 96. Then, strip 100 is wrapped in the opposite direction around strip 96 and strip 98 until its loop fasteners are engaged with both the hook fasteners of strip 96 and hook segment 110 of surface 104 of strip 98. The relative lengths of strips 98 and 100 and of segments 110 and 114 should be chosen to permit proper engagement of hook segments 114 with strip 96 and loop member 100 with both strip 96 and hook segment 110 of strip 98. Fasteners 92 and 94 are unfastened by reversing the fastening procedure.

As an alternative member 81, member 54 and the proximals panels can form a single unit.

FIGS. 5 through 7 show child restraint 200. Child restraint 200 is designed for substantially permanent mounting in an accessway. Accordingly, its width is not adjustable and it is not readily removable for remounting in another accessway.

Restraint 200 includes gate 210, fasteners 212 and 214 and hinges 216 and 218. One side of each of hinges 216 and 218 is suitably fastened, for example with screws, to wall 220 while the remaining side is suitably secured to gate 210. Gate 210 can be constructed from a suitable fiberboard. Accordingly, gate 210 can swing between an opened and closed position on hinges 216 and 218.

Gate 210 is secured in the closed position to post 222 with fasteners 212 and 214. Each fastener 212 and 214 includes strips 224, 226 and 228. Each of intermediate strip 226 and outer strip 228 is secured to gate 210 at one edge with a rivet 230. Inner strip 224 is wrapped around and secured to post 222. With the exception of their lengths and the lengths of the hook and loop segments of intermediate strip 226, the construction and use of fasteners 212 and 214 are identical to those of fasteners 92 and 94 of restraint 10, with the exception of their dimensions and the fact that the hook member and loop members are reversed. Strips 224, 226, 228 and the hook and loop segments of strip 226 should be dimensioned to permit proper fastening as described with respect to fasteners 92 and 94.

Figure 4:
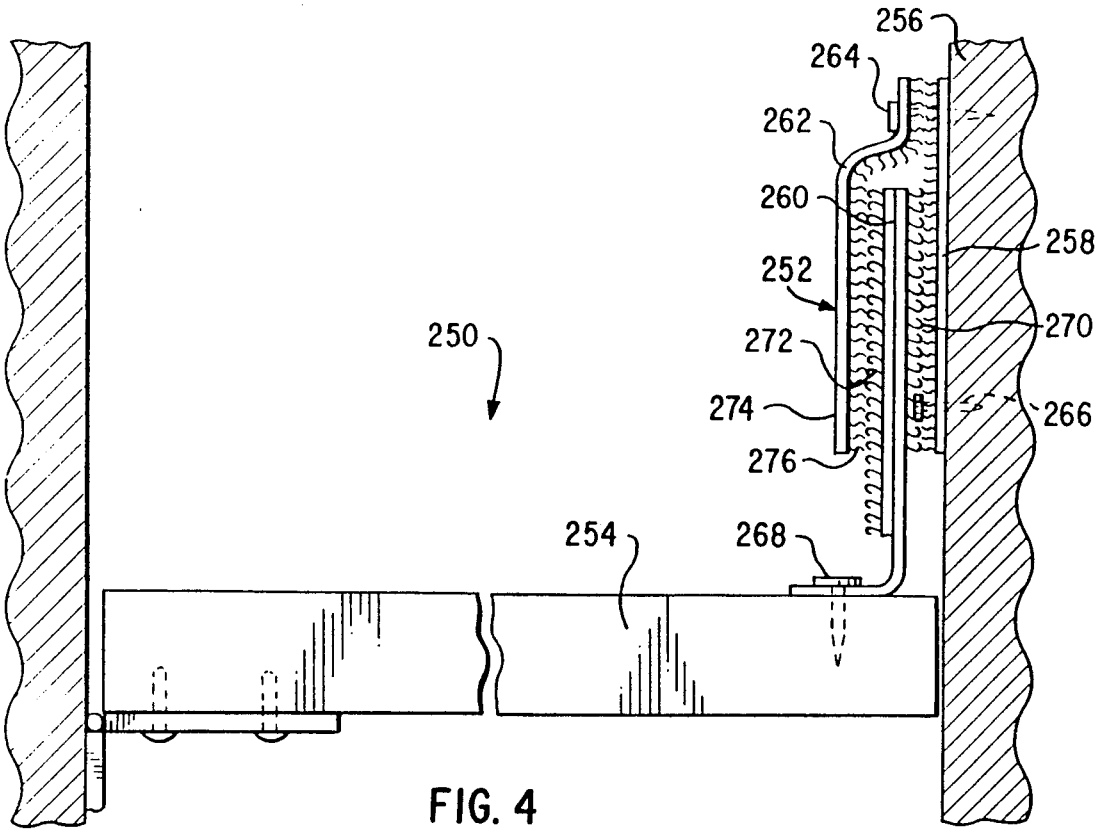
FIG. 4 is a top plan view of an alternate embodiment of the present invention.

FIG. 4 shows a restraint 250 that is identical to gate 200 except that it has been adapted for use in an accessway defined by two walls rather than by a wall and a railing post. In particular, FIG. 4 shows a fastener 252 that has been adapted from fasteners 212 and 214 to accommodate the securing of the open end of gate 254 to wall 256 rather than to a post. Fastener 252 includes strips 258, 260 and 262. Each of inner strip 258 and outer strip 262 is secured at one end to wall 256 with a screw 264. Strip 258 is secured at its remaining end to wall 256 with another screw 266. The exposed surface of strip 258 constitutes the loop material of a hook and loop fastener. One end of intermediate strip 260 is secured to gate 254 with a screw 268. Segments 270 and 272 of strip 260 constitute hook material. Surface 274 of strip 262 is smooth, while side 276 constitutes loop material.

Gate 254 is fastened in the closed position by moving gate 254 to the closed position shown in FIG. 4 and securing hook material 270 to strip 258. The loop material 276 of strip 262 is overlaid onto segment 272 to secure those two surfaces together. Unfastening fastener 252 is accomplished by reversing the fastening procedure.

With respect to each of fasteners 92, 94, 212, 214 and 252, the gate remains fastened in place when the outer strip is disengaged from the intermediate strip. Accordingly, an adult supervising a child can facilitate opening and closing the gate by leaving the outer strip disengaged. If more secure closure is desired, for example if the adult must leave the area occupied by the child or infant, the outer strip should remain engaged with the intermediate strip to increase the difficulty with which the child or infant can unfasten the fastener.

What is claimed is:

1. A fastener for releasably securing a first article to a second article comprising:

a first flexible fastening strip fixedly attached to the first article;

a second flexible fastening strip fixedly attached to the second article and adapted to grippingly engage with the first fastening strip but remote and independent therefrom when not engaged therewith;

a third flexible fastening strip fixedly attached to the second article and adapted to grippingly engage with the first strip when the first strip is engaged with the second strip in a manner which requires disengaging the third strip before the first strip can be disengaged from the second strip, said third strip independent from the second strip.

2. A fastener as described in claim 1 wherein the strips include hood-and-loop type fastening material.

3. A fastener for releasably securing an openable child restraint barrier to a securing member comprising:

a first flexible fastener strip fixedly attached to the securing member;

a second flexible fastening strip fixedly attached to the barrier and adapted to grippingly engaged with the first fastening strip;

a third flexible fastening strip flexibly attached to the barrier and adapted to grippingly engage with the first strip when it is engaged with the second strip in a manner which requires disengaging the third strip from the first strip before the first strip said third strip independent from said second strip can be disengaged from the second strip.

4. A fastener as described in claim 3 wherein the strips includes hook-and-loop type fastening material.

* * * * *